United States Patent [19]

Palson

[11] Patent Number: 4,501,068

[45] Date of Patent: Feb. 26, 1985

[54] POCKETKNIFE HONE

[75] Inventor: Richard C. J. Palson, Medfield, Mass.

[73] Assignee: The Phillips Manufacturing Company, Canton, Mass.

[21] Appl. No.: 484,899

[22] Filed: Apr. 14, 1983

[51] Int. Cl.[3] ..... B26B 5/00

[52] U.S. Cl. ..... 30/138; 30/157

[58] Field of Search ..... 30/138, 157, 147, 156

[56] References Cited

U.S. PATENT DOCUMENTS

| | | | |
|---|---|---|---|
| 19,606 | 3/1858 | Henn | 30/156 X |
| 416,946 | 12/1889 | Pilcher | 30/157 |
| 927,532 | 7/1909 | Heissenberger | 30/138 |
| 1,049,931 | 1/1913 | Smith | 30/157 |
| 2,213,064 | 8/1940 | Campos | 30/156 |
| 2,658,272 | 11/1953 | Lillard | 30/138 |

FOREIGN PATENT DOCUMENTS

| | | | |
|---|---|---|---|
| 775758 | 5/1957 | United Kingdom | 30/157 |

*Primary Examiner*—Jimmy C. Peters

*Attorney, Agent, or Firm*—Robert E. Meyer

[57] ABSTRACT

A pocketknife provided with a cutting blade and a sharpening blade wherein the two blades are sheathed within the handle and are pivotally movable from sheathed to extended positions characterized in that the sharpening blade, when extended, can be removed to enable its use for sharpening of the knife blade, but, when sheathed, is captured within the handle.

6 Claims, 11 Drawing Figures

POCKETKNIFE HONE

BACKGROUND OF INVENTION

Pocketknifes provided with honing devices incorporated therein for sharpening are old in the art. Specifically, the prior art discloses incorporating a hone in a recess formed in the exterior surface of the handle from which it can be removed for sharpening purposes. Structures of this kind are shown in U.S. Pat. Nos. 187,483; 1,232,886; 1,299,173; and 2,658,272. Heissenberger U.S. Pat. No. 927,533 shows a pocketknife wherein one side of the handle provides the hone and is pivotally connected at one side to the other side and removable therefrom to enable its use for honing purposes. Young U.S. Pat. No. 1,208,435 and Kjorsvik U.S. Pat. No. 2,416,929 show honing devices incorporated in the blade chamber so positioned that movement of the cutting blade into and out of the blade chamber effects sharpening of the blade. The structures shown in the aforesaid patents require undesirable modification of the knife handle to accept the honing devices. It is the purpose of this invention to provide a pocketknife structured to provide for sheathing the honing blade, together with the cutting blade in the blade chamber, without alteration of the handle and to permit easy removal of the honing blade for honing purposes and restoring it when not needed.

SUMMARY OF INVENTION

As herein illustrated, the pocketknife according to this invention comprises a handle defining a chamber longitudinally thereof, a pivot pin fixed to the handle at each end within the chamber, a knife blade pivotally mounted at one end on the pivot at one end of the chamber, a sharpening blade pivotally mounted at one end on the pivot pin at the other end of the chamber, said knife blade and sharpening blade being dimensioned to be housed within the chamber in parallel relation, spring means yieldably engaged with the knife blade and sharpening blade for holding the blades in sheathed and extended positions, and means detachably pivotally connecting the one end of the sharpening blade to its pivot pin when in its extended position, said means retaining the sharpening blade pivotally engaged with the pivot pin when in its sheathed position. The means detachably pivotally connecting the one end of the sharpening blade in one form comprises a part at the proximal end of the sharpening blade movable by rotation of the sharpening blade to a sheathed position within the chamber to a position between the underside of the pivot pin and the spring to capture the proximal end of the sharpening blade within the chamber and by rotation of the sharpening blade to an extended position above the pivot pin, to release the sharpening blade from the chamber. The aforesaid part, in one form, comprises an extension of one of the longitudinal edges of the sharpening blade, one side of which constitutes an extension of said longitudinal side and defines an arcuate surface for receiving the pivot pin and the other side of which is beveled. Alternately, the part comprises a hook at the proximal end of the sharpening blade defining an open end slot for rotatably receiving the pivot pin, so positioned that when the sharpening blade is sheathed within the chamber, the bite of the hook is engaged with the underside of the pivot pin, thus capturing the proximal end of the sharpening blade and when the sharpening blade is extended is engaged with the top side of the pivot pin, thus freeing the proximal end of the sharpening blade from the pivot pin. The hook defines a slot corresponding in width to the diameter of the pivot pin.

The invention will now be described in greater detail with reference to the accompanying drawings, wherein.

The invention as herein disclosed resides in providing a pocketknife with a sharpening blade in the form of a hone which is sheathed, together with the cutting blade, within the handle and is pivotally extendable therefrom and removable from the handle to enable its use for sharpening purposes.

Figure 1:
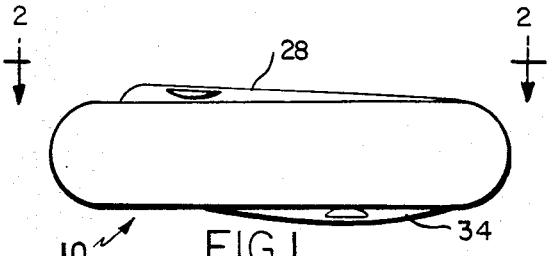
FIG. 1 is an elevation of one form of pocketknife embodying the invention wherein the cutting blade is installed in one side of the blade chamber and a sharpening blade is installed in the side of the blade chamber.
Figure 2:
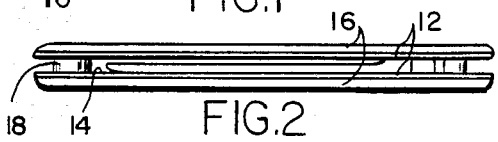
FIG. 2 is a plan view of the pocketknife shown in FIG. 1 taken on the line 2—2 of FIG. 1.
Figure 3:
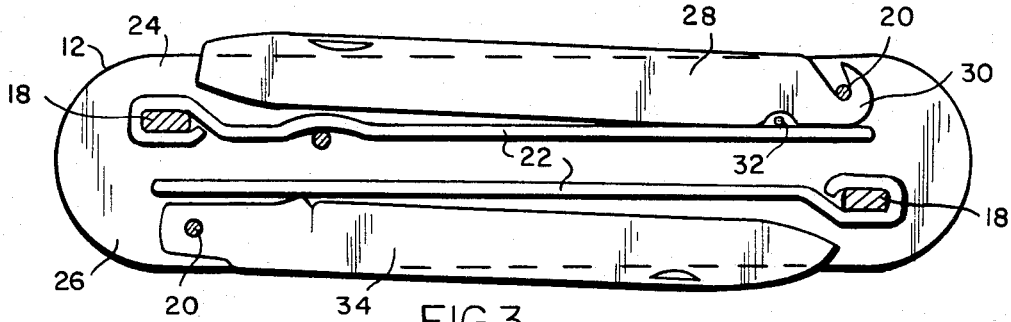
FIG. 3 is a longitudinal section of the pocketknife shown in FIGS. 1 and 2 to larger scale with parts in elevation.
Figure 7:
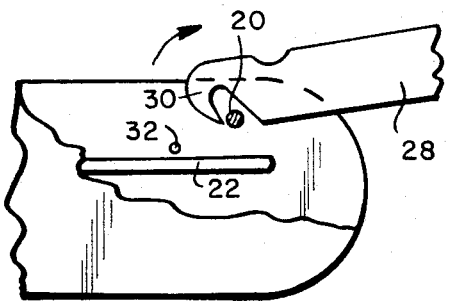
FIG. 7 is a fragmentary elevation showing the extended position of the sharpening blade.
Figure 8:
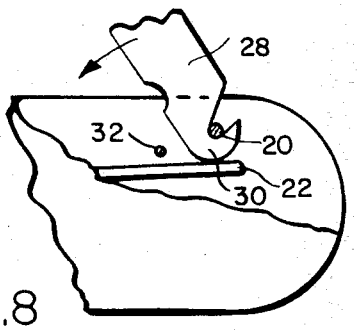
FIG. 8 is a fragmentary elevation showing the sharpening blade in a position intermediate its extended and sheathed positions pivotally coupled to the pivot pin.

Referring to the drawings, FIGS. 1 to 3, the pocketknife in one form comprises a handle 10 constructed of spaced, parallel frame members 12—12 defining a knife receiving chamber 14, to the outer sides of which are fastened handle members 16—16. The frame members 12—12 are secured in spaced, parallel relation by transverse anchoring members 18—18 and by transverse pins 20—20. In the form of the invention as shown in FIGS. 1 to 3, leaf spring members 22—22 are fixed at one end to the respective transverse members 18—18 and extend in opposite directions within the chamber 16 dividing the chamber into an upper part 24 for receiving a sharpening blade 28 and a lower part 26 for receiving a cutting blade 34. The sharpening blade 28 is provided with a hook 30 at one end for pivotally receiving the pin 20 at that end so that the sharpening blade, as shown in FIGS. 7 and 8, can be rotated in a clockwise direction to position the bite of the hook at the upper side of the pin 20 and thus to enable removing the sharpening blade. FIG. 8 shows the sharpening blade 28 in an intermediate position between its sheathed and extended positions with the hook 30 engaged with the pin 20 and FIG. 7 shows the sharpening blade in its extended position, in which position it can be disengaged from the pin 20. In order to prevent the spring from springing out of the housing 24 when the sharpening blade is removed, a pin 32 is provided for constraining the distal end of the spring when the sharpening blade is removed. The cutting blade 34 is pivotally connected to the pin 20 at its proximal end within the chamber 26 and can be moved into and out of the chamber by pivotal movement about the pin 20. The spring 22 provides for yieldably holding the blade in either its sheathed or extended position.

Figure 4:
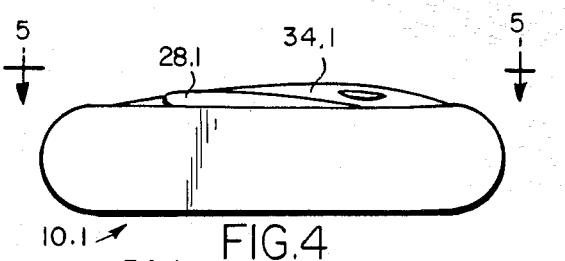
FIG. 4 is an elevation of another form of the pocketknife of this invention wherein the cutting blade and sharpening blade are installed in the blade chamber side-by-side.
Figure 5:
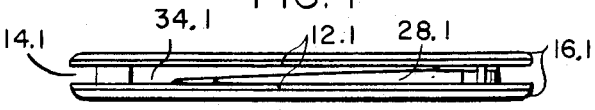
FIG. 5 is a plan view of the pocketknife shown in FIG. 4 taken on the line 5—5 of FIG. 4.
Figure 6:
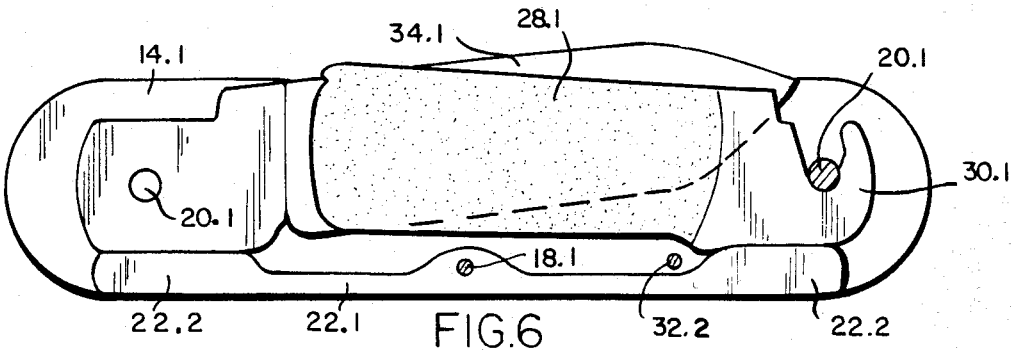
FIG. 6 is a longitudinal section of the pocketknife shown in FIGS. 4 and 5 to larger scale with parts in elevation.

In the alternate form, shown in FIGS. 4 to 6, the handle 10.1 is constructed of spaced, parallel frame members 12.1 which define a knife-receiving chamber 14.1, to the outer sides of which are fastened handle members 16.1. The frame members 12.1 are secured in spaced, parallel relation by transverse anchoring members 20.1 which provide the pivot pins for the blades. In the form of the invention shown in FIGS. 4 to 6, a single leaf spring member 22.1 is fixed between the frame members intermediate its ends and extends in opposite directions within the chamber 14.1 along one side so that its opposite ends 22.2 underlie the pivot pins 20.1. A sharpening blade 28.1 is provided with a hook 30.1 at one end for pivotally receiving the pivot pin 20.1 at that end so that the sharpening blade as shown can be rotated in a clockwise direction to position the bite of the hook 30.1 at the upper side of the pivot pin 20.1 and thus to enable removing the sharpening blade in the same manner as shown in FIGS. 7 and 8 referred to in describing the manipulation of the sharpening blade as disclosed in FIGS. 1, 2 and 3. The spring member 22.1 is secured between the side members 12.1 by a pin 18.1 and the end adjacent the pivot pin upon which is pivoted the sharpening blade is constrained by a pin 32.2. The cutting blade 34.1 is pivotally connected at its proximal end to the pivot pin 20.1 at that end.

Figure 9:
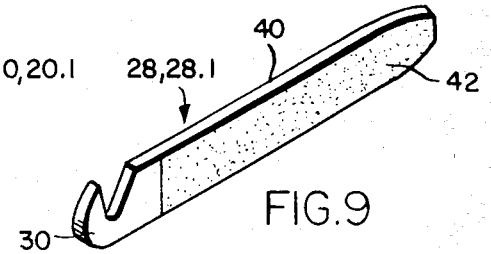
FIG. 9 is a perspective view of the sharpening blade removed from the knife handle.

The sharpening blade, as shown in FIG. 9, comprises a metal blade 40 to one side of which is attached a layer 42 of abrasive material.

Figure 10:
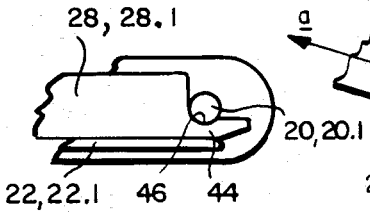
FIGS. 10 and 11 are fragmentary views showing an alternate form of means for detachably coupling the sharpening blade to the pivot pin.
Figure 11:
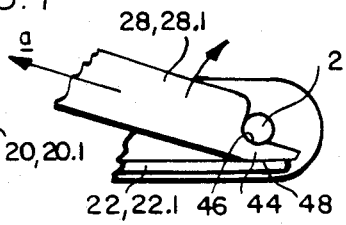

An alternative structure for detachably pivotally mounting the sharpening blade 28 or 28.1 is shown in FIGS. 10 and 11 wherein the proximal end of the sharpening blade is provided with an extension 44 which comprises an elongation of one edge of the blade, one side of which embodies a concave bearing surface 46 and the other side of which is beveled at 48. The extension is dimensioned to be interjected between the spring 22 or 22.1 and the pin 20 or 20.1 and in the sheathed position as shown in FIG. 10, engagement of the pin with the concave bearing surface 46 will retain the blade in place. The blade can be readily removed, however, by rotating it in a clockwise direction until the beveled surface 48 is engaged with the spring and then pulling the blade in the direction of the arrow a to disengage the bearing surface from the pin.

The structure described in its several forms provides a very simple and inexpensive way of incorporating a sharpening blade in a pocketknife without substantial alteration of the conventional structure of the knife, which conceals the sharpening blade when not in use and yet enables easily removing it for sharpening purposes.

It should be understood that the present disclosure is for the purpose of illustration only and includes all modifications or improvements which fall within the scope of the appended claims.

What is claimed is:

1. A pocketknife comprising a handle defining a blade-receiving chamber longitudinally thereof, a pivot pin fixed to the handle at each end within the chamber, a knife blade pivotally mounted at one end on the pivot at one end of the chamber, a sharpening blade pivotally mounted at one end on the pivot pin at the other end of the chamber, said knife blade and sharpening blade being dimensioned to be sheathed within the chamber in parallel relation to each other for movement from a sheathed position within the chamber to a position extending therefrom, spring means yieldably engaged with the proximal end of the knife blade and the proximal end of the sharpening blade for holding the blades in sheathed and extended positions, and means pivotally connecting the sharpening blade to its pivot pin, structured to detachably connect said one end of the sharpening blade to its pivot pin, said means retaining the sharpening blade pivotally engaged with the pivot pin when in its sheathed position and releasing the sharpening blade from its pivot pin when in its extended position.

2. A pocketknife according to claim 1 wherein said means detachably connecting said sharpening blade to its pivot pin comprises a part at the proximal end of the sharpening blade movable by rotation of the sharpening blade to a sheathed position within the chamber to a position between the underside of the pivot pin and the spring means at that end to thus capture the proximal end of the sharpening blade within the chamber and by rotation of the sharpening blade to an extended position to a position above the pivot pin to release the sharpening blade from the chamber.

3. A pocketknife according to claim 1 wherein the means detachably connecting said sharpening blade to its pivot pin comprises a hook at the proximal end of the sharpening blade defining an open-ended slot for rotatably receiving the pivot pin, so positioned that when the sharpening blade is sheathed within the chamber, the bite of the hook is engaged with the underside of the pivot pin, thus capturing the proximal end of the sharpening blade between the pivot pin and the spring at that end and when the sharpening blade is extended, the bite is engaged with the top of the pivot pin, thus freeing the proximal end of the sharpening blade from the pivot pin.

4. A pocketknife according to claim 2 wherein said part comprises an extension of one of the longitudinal edges of the sharpening blade, one side of which contains an arcuate bearing surface for receiving the pivot pin and the other side of which is beveled.

5. A pocketknife according to claim 3 wherein the hook defines a slot corresponding in width to the diameter of the pivot pin.

6. A pocketknife according to claim 1 wherein the sharpening blade has an abrasive surface on at least one longitudinal side thereof.

* * * * *